United States Patent [19]

Von De Linde

[11] 4,317,302

[45] Mar. 2, 1982

[54] SIGN CABINET WITH BOX BEAM SUPPORT FRAME AND CLAMP ASSEMBLIES

[75] Inventor: Dennis J. Von De Linde, Afton, Minn.

[73] Assignee: Minnesota Mining and Manufacturing Company, St. Paul, Minn.

[21] Appl. No.: 163,642

[22] Filed: Jun. 27, 1980

[51] Int. Cl.[3] ..... G09F 13/00

[52] U.S. Cl. ..... 40/549; 40/156; 40/603; 40/564

[58] Field of Search ..... 40/152, 156, 152.2, 40/564

[56] References Cited

U.S. PATENT DOCUMENTS

| | | | |
|---|---|---|---|
| 1,219,236 | 3/1917 | Brewster | 40/564 X |
| 2,083,258 | 6/1937 | Fisher | 40/564 X |
| 2,573,318 | 10/1951 | Dow | 40/584 X |
| 2,893,162 | 7/1959 | Knowles | 40/603 |
| 3,080,166 | 3/1963 | Clark | 273/102 |
| 3,235,989 | 2/1966 | Brooks | 40/564 X |
| 3,390,259 | 5/1968 | Angier | 40/564 X |
| 3,391,481 | 1/1968 | Lloyd | 40/549 X |
| 3,395,483 | 8/1968 | Stein et al. | 40/549 |
| 3,593,448 | 7/1971 | Schoepf | 40/564 |
| 3,722,119 | 3/1973 | Braun | 40/564 |
| 3,835,613 | 9/1974 | Davies | 52/656 |
| 3,848,349 | 11/1974 | Olsen | 40/564 |
| 3,863,372 | 2/1975 | Stilling | 40/564 |
| 3,893,251 | 7/1975 | Coleman | 40/541 |
| 4,007,552 | 2/1977 | Brooks | 40/549 |
| 4,041,861 | 8/1977 | Alter | 101/128.4 |
| 4,169,327 | 10/1979 | Stilling | 40/549 |

*Primary Examiner*—Gene Mancene
*Assistant Examiner*—Wenceslao J. Contreras
*Attorney, Agent, or Firm*—Cruzan Alexander; Donald M. Sell; Robert W. Burns

[57] ABSTRACT

This invention relates to on premise display sign cabinets having a main frame and a support frame formed by an extended box beam, the latter being rectangular in cross section, said support frame being disposed along the periphery of the main frame and being of sufficient structural strength to substantially reduce the need for support braces and carrying a plurality of individual slidable clamping assemblies in a raceway at one side of the beam to secure and maintain a polyvinyl chloride sign face under tension sufficient to withstand wind forces exceeding 50 pounds per square foot on the sign face.

20 Claims, 8 Drawing Figures

SIGN CABINET WITH BOX BEAM SUPPORT FRAME AND CLAMP ASSEMBLIES

TECHNICAL FIELD

This invention relates to sign cabinets used for outdoor signing in which the cabinet contains a main frame affixed to a support frame formed by box beams, preferably of extruded aluminum. The box beams contain a race in which a plurality of individual clamp assemblies are mounted to secure the marginal edges of a flexible sign face to the support frame and retain the face under tension within the cabinet to withstand wind forces exceeding 50 pounds per square foot (244 km/m$^2$).

BACKGROUND ART

There are numerous sign cabinets in the prior art, many consisting of aluminum extruded frames. However, most of the prior art cabinets are directed to securing one or more translucent rigid plastic sign faces.

For example, Davies, U.S. Pat. No. 3,835,613 shows a frame with retainers 4 and 5 adapted to hold a rigid plastic display face 7 in an offset 50 (see FIGS. 4 and 5). The panel 7 has a shoulder which rests upon the offset 40.

Brooks, U.S. Pat. No. 4,007,552 likewise shows an extruded aluminum web 18A to secure a rigid sign face 12 against the main frame 14. Sign face 12 has shoulders 82 which are secured upon offset 26 of the main frame.

Lloyd U.S. Pat. No. 3,391,481 shows aluminum retainers such as 6 in FIG. 5 extending along the sides of the frame. A rigid panel B is held in place by the retainer and seats on all four walls formed by the retainer 6.

Angier U.S. Pat. No. 3,390,259 shows an aluminum frame forming central enclosures at 22 and 38 to house flourescent tubes, etc. and a skirt extending from each side, one end of the skirt forming a drainage channel and the opposite end seating rigid panels 2 and 4. The panels are supported at the bottom by retainer 56.

Brooks U.S. Pat. No. 3,235,989 discloses a main frame 2 with retainers 39 forming walls 53 and 54 to form a flange which holds rigid panels 22 in the flanges which extend along the bottom of the frame.

Some of the prior art shows means to tension a display face in the form of a film. For example Braun U.S. Pat. No. 3,722,119 discloses a polyvinyl chloride film 41 held and sealed from the elements by a pane 36, strips 38 and flaps 40 within a frame designated 24. Dow U.S. Pat. No. 2,573,318 shows a fabric banner 3 mounted under tension by rotatable clips 7.

Other prior art teachings are related to tensioning fabrics suitable for screen printing. For example Knowles U.S. Pat. No. 2,893,162 shows an arcuate clamp 17 extending along the entire length of each side of the frame. The clamp contains a pair of bars 20 and 19 which engage the marginal edges of the screen and secure it in the arcuate portion of the clamp 17. Tension is placed upon the screen by adjusting the nut 21.

Likewise Alter U.S. Pat. No. 4,041,861 is directed to a clamping means for screen printing. In this disclosure a clamp 24 is slidable on a rail 27 which is integral with a bar 23. The bar is moved into tensioning position by means of bolts 14. In this disclosure, the clamps secure substantially the entire marginal edge of screen 11, the clamps at each corner of the frame being slidable along the rail (such as at end E in FIG. 2) after full tension force is attained.

One of the basic problems with prior art sign cabinets is that they are directed to securing rigid plastic sign faces. These devices are not designed to provide sufficient structural strength to maintain a flexible PVC sign face under the substantial tension required to withstand forces exerted by wind gusts exceeding 100 miles (160 kmh) per hour. Wind velocities of this nature are common and often exceeded in many parts of the United States. Prior art rigid plastic faces tend to "blow out" at wind velocities of 100 miles per hour (160 kmh) or less and further are highly susceptible to vandalism, such as throwing objects at a sign face. In contrast, PVC sign faces suspended under tension will withstand wind velocities exceeding 100 miles per hour (160 kmh) without breaking and are also highly resistant to impacts such as from thown rocks which tend to bounce off the tensioned face. Further, PVC sign faces resist propagation of cuts or holes even when the cuts are not repaired. PVC sign faces thus offer a great many advantages over prior art rigid translucent plastic faces.

The few prior art devices that are designed to clamp and secure flexible sheets under tension are generally patterned after the sign cabinets used to house rigid plastic faces. Sign cabinets of this kind are not satisfactory to suspend flexible faces as it has been found that large PVC sign faces supported under tension and exposed to significant wind gusts exert extreme forces on the perimeter of the cabinet. Such forces are the result of the force on the frame produced by mounting the face under tension as well as the force of the wind exerted against the sign face. In order to compensate for these forces and to prevent buckling of the frame, it is necessary in prior art cabinets to add a considerable number of support or cross braces. This results in added weight and expense in relation to both production of the frame and installation at site.

Additionally, prior art cabinets, such as those disclosed by Braun and Dow, secure the marginal edges by panes or rotative clips. Using these prior art devices, it is difficult to suspend a flexible sign face of large size without attendant wrinkling and puckering which result in uneven appearing faces.

This invention alleviates the above problems by providing a box beam coextensive with the sign cabinet frame. The box beam when viewed in cross-section has a rectangular configuration and supports a clamping system along one side which maintains the PVC sign face under proper tension. The beam adds considerable strength to the cabinet and therefore the length of span between support members is greatly increased, thus decreasing the need for complex support braces and the weight of the cabinet.

DISCLOSURE OF INVENTION

This invention relates to a sign cabinet having a main frame which supports box beam members forming a support frame coextensive with the main frame. The support frame supports a plurality of individual clamping assemblies. The support frame formed by the box beams can be mounted on each side of the main frame so that the sign cabinet will have two display faces, one on each side. Alternatively, the support frame may be mounted only on one side of the frame so that the sign cabinet has a display face showing the advertising message only at a single side, the opposite side being attached to a building, etc.

In cross-section the box beam is of rectangular configuration and its walls contain a race for clamping assemblies and at least one channel to mount the box beam frame to the main frame. The race is positioned opposite the side of the beam that is affixed to and adjacent the main frame. This race is adapted to receive a series of clamp support bars slidable within the race. Each support bar is individually mounted in and extends out from the race. The distal ends of each individual support bar supports a clamp assembly which in turn secures the marginal edge of a flexible sign face preferably of reinforced polyvinyl chloride. The clamp assemblies can be adjusted or positioned to secure the face under tension and prior to tensioning, can be moved with the support bars along the race so that the individual clamps may be positioned along the periphery of the face to hold the face under tension without substantial wrinkling, puckering or other uneven surfaces. Each clamp assembly is positioned and tensioned individually with a minimum of effort.

The channels in the box beams provide recesses which attach the support frame to the cover and the main sign cabinet frame, the latter including a support plate to engage the beams. However, special support plates can be designed and fitted to the box beams of the support frame in order to retrofit the beam to the framework of existing sign cabinets.

The support frame consisting of box beams adds considerable structural strength along the perimeter of the sign frame. For example, in a 7×14 foot (2.1×4.3 m) sign cabinet, the beam permits a span of up to 78 inches (1.98 m) without the need for extra support rods or other supporting structure.

DETAILED DESCRIPTION

The sign cabinet of this invention, generally designated 10, and shown in FIGS. 1–4 consists of the parts hereinafter described and is mounted on a supporting post 11 or other suitable supports. The sign cabinet can be used for various types of road signing purposes, particularly "on premise" signing which for example involves elevated signs on the premises of service stations, motels, restaurants, etc. along interstate freeways. The overall configuration of the sign 10 may be rectangular or square shaped with squared or radius (rounded) corners. The cabinet can be constructed so that it supports a display face on both sides and is thus visible from opposite directions or the display face may be supported on only one side of the cabinet.

Cabinet 10 is completely enclosed to form a substantial weather proofed housing and may have one of more fluorescent lamps disposed vertically or horizontally within the cabinet to provide illumination at night.

Figure 2:
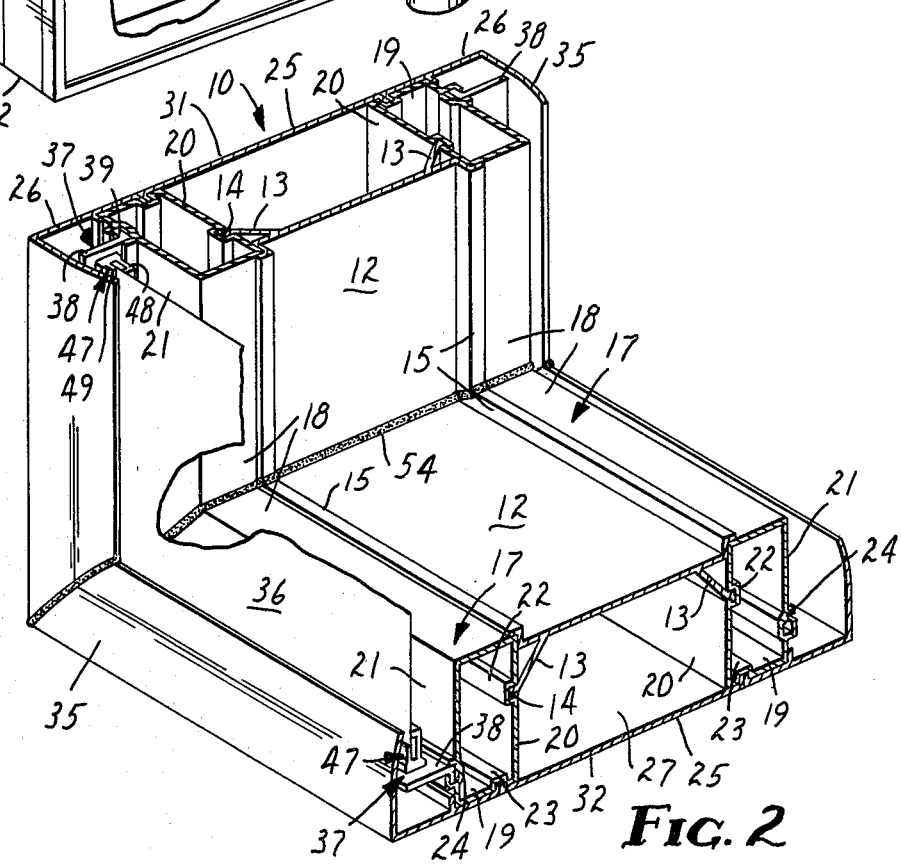
FIG. 2 is a perspective view of a lower corner of the sign cabinet partially broken away to show the arrangement of the box beam support frame, main frame and clamping system.
Figure 3:
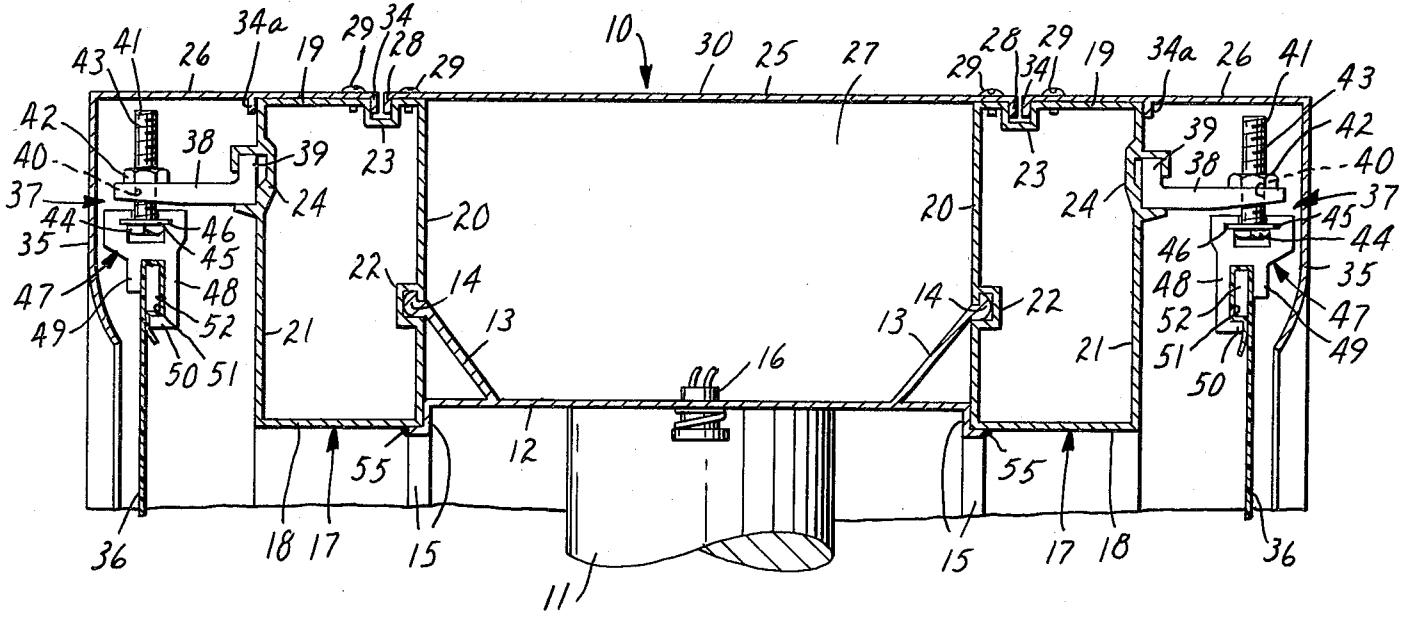
FIG. 3 is a sectional view taken along the lines 3—3 of FIG. 1.

One component of this invention consist of a divider or main frame 12 shown in FIGS. 2 and 3. The frame is a substantially planar sheet of aluminum with angularily inclined integral support members 13 extending from the plane of the frame 12 at an approximate 45° angle from each edge of the frame. The face or distal ends of plates 13 have a bulbous locking member 14. Along each side of main frame 12 is an integral support bar having an L-shape configuration for the purpose of forming a pair of support flanges 15 along each side of the frame 12.

Frame 12 may support light sockets 16 on which fluoroescent lamps may be mounted to illuminate the interior of cabinet 10. Additionally, as seen in FIG. 3, post 11 or other support means are suitably secured to main frame 12 to mount the sign cabinet on post 11 or other structure such as the side or top of buildings.

Main frame 12 secures and supports an important component of the invention, namely a completely enclosed rectangular support frame 17 formed by four lengths of box beams, which with frame 12 forms the basic peripheral frame work or sign cabinet 10. As seen by viewing FIG. 1, the cabinet is formed in a substantially square or rectangular configuration having a top span, a bottom span and opposite side spans. Support frame 17 has four box beams each having a bottom wall 18, top wall 19 and opposing side walls 20 and 21. As best visualized by viewing FIGS. 1 and 2, the frame 17 is coextensively secured to main frame 12 around the entire periphery of the frame. In the figures, the support frame 17 is secured to both sides of main frame 12.

The box beams of support frame 17 have a race which extends along the entire length of side wall 21 thereof and thus about the support frame. The box beams are also formed with channels 22 and 23, channel 22 is formed in side wall 20 and forms a recess in which the locking member 14 of frame 12 mates with the box beam. Locking member 14 is secured in the recess by any suitable means, such as by welding. To complete attachment of frame 17 to main frame 12, the corner of the lower wall 18 and inner wall 20 of frame 17 is seated in flange 15 of frame 12 and suitable secured thereto, such as by welding.

It should be noted that the sign cabinet depicted in the drawings contemplates a cabinet having a display face on each side. If only a single sign face is desired, the support frame 17 formed by the box beams is affixed to only one side of frame 12. In such event the opposite side of frame 12 is truncated so that a rear panel can be disposed over the entire backside of the cabinet for installation on the side of or on top of buildings.

It should also be noted that the structural form of main frame 12 shown in the drawings can be substituted by the frame already in place on an existing sign cabinet. In such case, support frame 17 is retrofitted to the existing frame by any suitable means, such as by bolting or welding.

A second channel 23 is formed in upper wall 19 of each box beam and secures cover member 25 and a retainer 26. Cover 25 extends entirely over frame 12 in spaced relation thereto forming an enclosure 27 which extends around the periphery of cabinet 10. Enclosure 27 provides a weather-tight housing in which lamp socket 16, lamps, ballasts, electric wiring, etc. are housed.

Cover 25 contains a downturned edge member 28 which fits into channel 23 of the beams to assist in securing the cover. Cover 25 is also secured to wall 19 by means of sheet metal screws 29 or the suitable fastening means.

Figure 1:
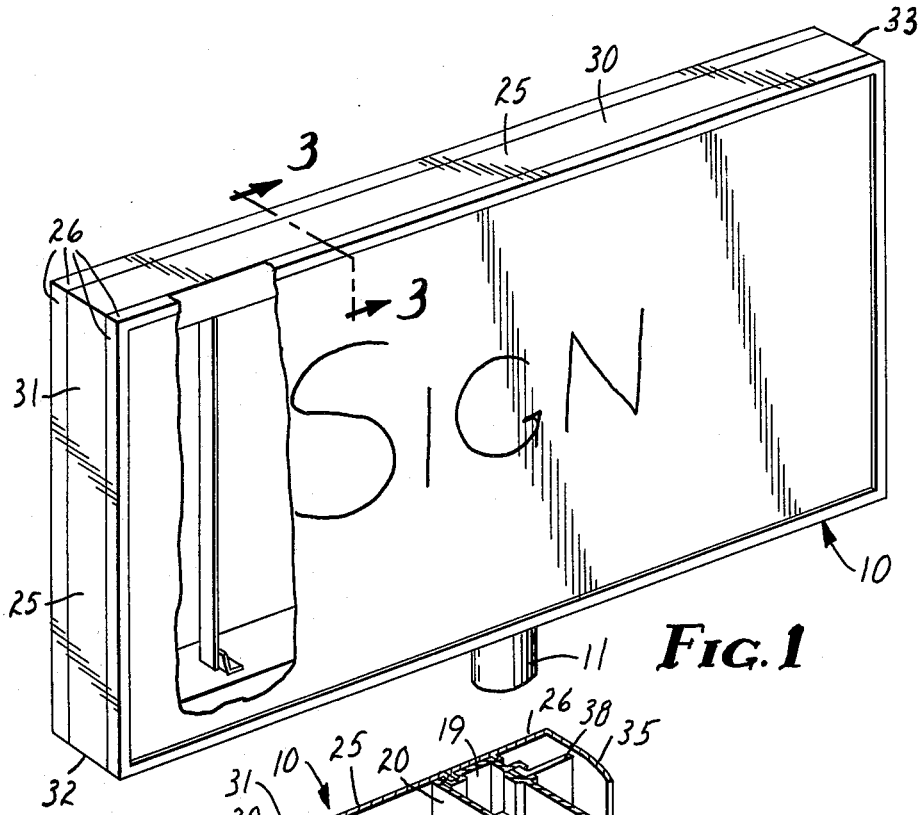
FIG. 1 is a perspective view of the sign cabinet embodying this invention.

As can be visualized from FIG. 1 when the cabinet is completely assembled cover 25 forms four separate spans or panels 30, 31, 32 and 33. When it is desired to exchange fluorescent lamps or carry out other maintenance operations in the cabinet, panels 30–33 can each be removed by unscrewing the proper sheet metal screws. Access holes (not shown) in frame 12 permit removing of the lamps, etc. in the interior of the cabinet.

Channel 23 also forms a drain for any excess moisture that may form along the top of the cabinet. Moisture follows the channel along the top of the cabinet to the sides.

Retainer 26 has a downturned edge 34 that also fits in channel 23 and extends over the top and beyond frame 17. A stop 34*a* assists in positioning the retainer over the upper wall 19 of the box beams. Retainer 26 has an extension 35 which extends normal to the plane of cover 25, the distal end of the extension turning slightly inward to "frame" or cover the periphery of the display face suspended in the sign cabinet. Similar to cover 25, the retainer can be secured to top wall 19 of beam 17 by means of sheet metal screws 29.

Race 24 formed on wall 21 of the box beams of support frame 17 represents in cross section a reverse G-shaped configuration to slidably secure clamp assemblies generally designated 37. The assemblies 37 hold sign face 36 under tension. A plurality of these individual assemblies are disposed within the area formed by retainer 26 and extension 35 as best visualized in FIG. 3. Each clamp assembly 37 has a clamp support bar 38 best seen in FIGS. 3 and 4 which is slidably seated in race 24 by means of a flanged lip 39 so that the clamp assemblies can be disposed at desired position along the G-shaped race 24.

Figure 8:
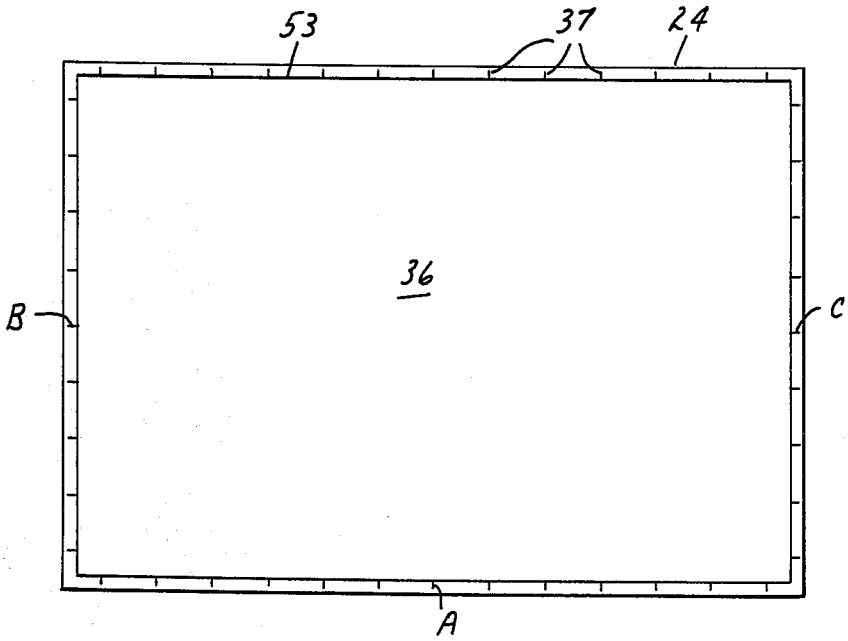
FIG. 8 is a schematic diagram showing the clamp assemblies positioned in an array along the race of the box beams to hold the sign face under tension.

As schematically visualized by viewing FIG. 8, the clamp assemblies 37 are disposed in race 24 so that each individual clamp assembly 37 is positioned diametrically opposite another assembly on the opposite side of the cabinet. Each of the assemblies can be mounted in the race 24 and positioned as shown in FIG. 8.

Figure 4:
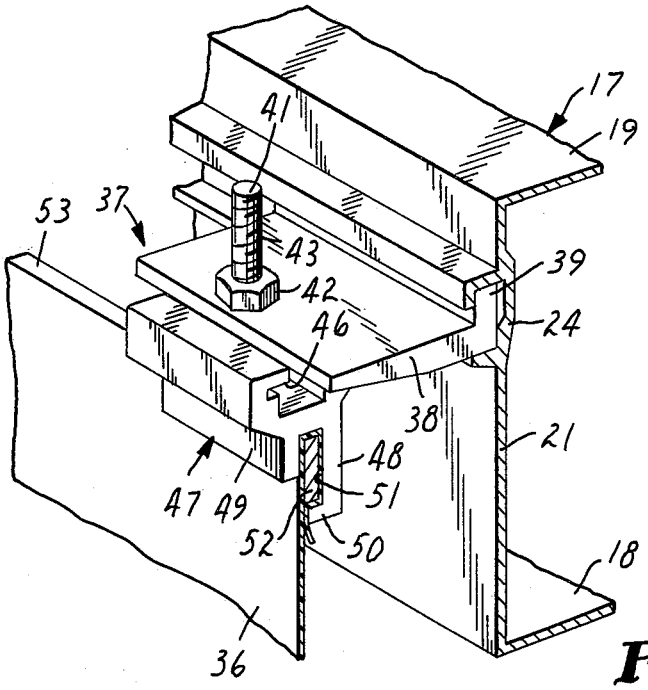
FIG. 4 is a perspective view of the clamping assembly in position on the support frame.

As seen in FIGS. 3 and 4, an aperture 40 at the clamp support head or distal end of bar 38 permits the shank of wedge clamp bolt 41 to be inserted therein. A nut 42 is secured along the threaded shank of bolt 41 so that it adjustably seats the bolt on bar 38. The head 44 of bolt 41 along with washer 45 (See FIG. 3) seats within a groove 46 of a wedge clamp member generally designated 47. The wedge clamp 47 consists of two stubs 48 and 49 extending downwardly from the upper portion of member 47. Stub 48 is somewhat longer than stub 49 and the distal end of the former has a lug 50 which with stubs 48 and 49 forms a recess 51 to seat a hanger bar 52. Hanger bar 52 is slightly longer than the linear length of wedge clamp 47.

Sign face 36 is of flexible material and preferably consists of reinforced polyvinyl chloride sheet material such as a PVC sheet material sold by National Advertising Company under the registered trademark PANAFLEX Sign Face Material. This material, although flexible and light in weight, can withstand up to 100 pounds (17.86 kg) or more of tension per linear inch (per linear centimeter) of material without tearing or breaking and has considerable elastic capabilities even when mounted under tension thus eliminating blowouts from wind gusts of high velocity and breakage due to vandalism, etc.

In mounting face 36, the marginal edges 53 are preferably marked so that they can be suitably wrapped around the hanger bars 52, the marking permitting the desired amount of marginal material to be wound around the bar.

Referring to FIGS. 4 and 8, the preferred method to mount face 36 is to secure the marginal edges 53 along the upper edge of the face by wrapping it around the individual bars 52 after the bars have first been removed from recesses 51. As edge 53 is wrapped over each bar, the bar is then inserted in the recess 51 until the entire upper marginal edge of face 36 is secured to the individual assemblies disposed in race 24 of the support frame 17 on the upper span of beam across the top of the cabinet 10. The next step, as best visualized in FIG. 8, is to wrap the bottom of the marginal edge 53 around bar 52 which has been removed from the wedge clamp 47 of the center clamp assembly 37 shown at the point A in FIG. 8 and inserted in recess 51. The clamp assembly 37 (and its wedge clamp 47) at the point A and the clamp assembly (with its wedge clamp) directly opposite to it along the upper span of beam are each tightened by turning nut 42 on threads 43. The tightening provides some tension on face 36.

At this point, the marginal edge extending along one of the sides of the cabinet are then similarly wrapped around bar 52 which is then attached via recess 51 to a clamp assembly 37 located centrally in recess 24 at one of the sides of the cabinet such as at point B shown in FIG. 8. The marginal edge 53 along the opposite side of face 36 is then likewise loaded onto a clamp assembly 37 located at position C in race 24 in FIG. 8 and the two clamps are tightened as described above. This provides the initial tension along all four sides of sign face 36.

Once face 36 is attached as described above, the marginal edge 53 is then affixed to all of the remaining individual clamp assemblies 37 by means of inserting bar 52 into the respective recesses 51 of the wedge clamp of the various clamp assemblies. Each individual clamp assembly along the entire array as shown in FIG. 8 can then be individually tightened so as to exert the exact and required tension on face 36. Once partially tightened, any of the individual clamp assemblies 37 can be slidably moved along race 24 for short distances by tapping on the clamp support bars 38 with a light hammer or other similar tool. Thus, the individual clamp assemblies 37 can be positioned and then tightened in selected position to reduce and eliminate puckering and wrinkles in face 36 and provide the precise amount of tension on face 36 required to resist the impact of high wind velocities.

Although the various components of cabinet 10, such as main frame 12, support frame 17, cover 25, retainer 26 and the clamp assemblies 37, can be made from any suitable material, extruded aluminum is preferred because of its light weight and comparative ease of manufacture and fabricating. For example, all of these components can be produced by an aluminum manufacturer by well known extrusion methods so that each of the components (main frame 12, the box beams of support frame 17, cover 25 and retainer 26) can be cut into stock lengths and shipped with appropriate clamping assemblies 37 and faces 36 to sign fabricators who then produce custom made signs for their customers. In each case, the sign fabricator preassembles the cabinet by fitting support frame 17 to frame 12 via fitting locking means 14 into channel 22 and seating the support frame in flange 15. The cover 25 and retainer 26 are then temporarily secured by inserting their edges 28 and 34 into channel 23. The preassembled unit is then cut to desired lengths to form the top, sides and bottom spans of sign cabinet 10 and (usually simultaneously with cutting) the corners of each length are mitered for proper corner fitting as visualized by viewing FIG. 2. At this point cover 25 and retainer 26 are then removed from the preassembled unit and main frame 12 and support frame 17 formed by the box beams permanently secured by welding the mitered corners at welds 54 and welding at spaced intervals, the locking means 14 and side wall 20 to flange 15 via welds 55. The welded unit is then suitably secured to post 11 and cover 25 in turn secured over beams 17 and over frame 12 by means of downturned edges 28 and sheet metal screws 29 fastened to wall 19 of the channel member. If a single sign face is being assembled, one end of cover 25 is suitably secured to a backing panel rather than to a second or opposed support frame 17. The clamp assemblies 37 and face 36 are then secured to the cabinet as described above and finally retainer 26 is secured to wall 19 and race 23 by means of edge 34 and screws 29. The fully assembled unit can be taken to the customer's site and erected by any of several well-known procedures.

Figure 6:
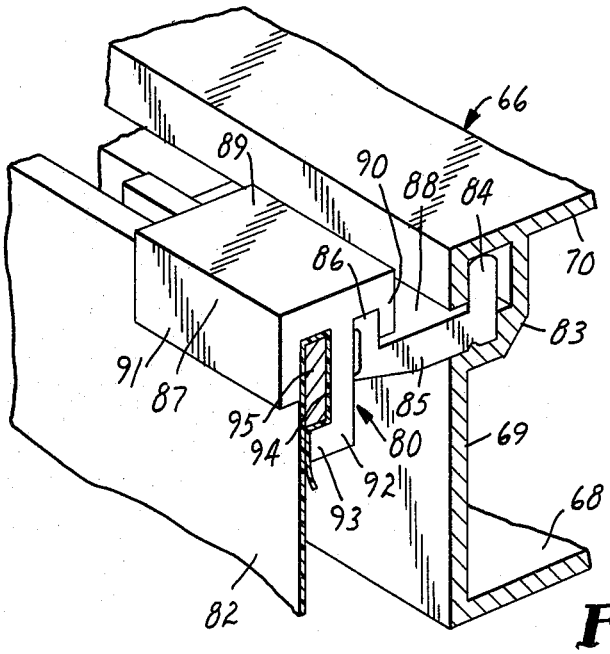
FIG. 6 is a view of the clamping assembly of the FIG. 5 modification in position on the support frame.
Figure 5:
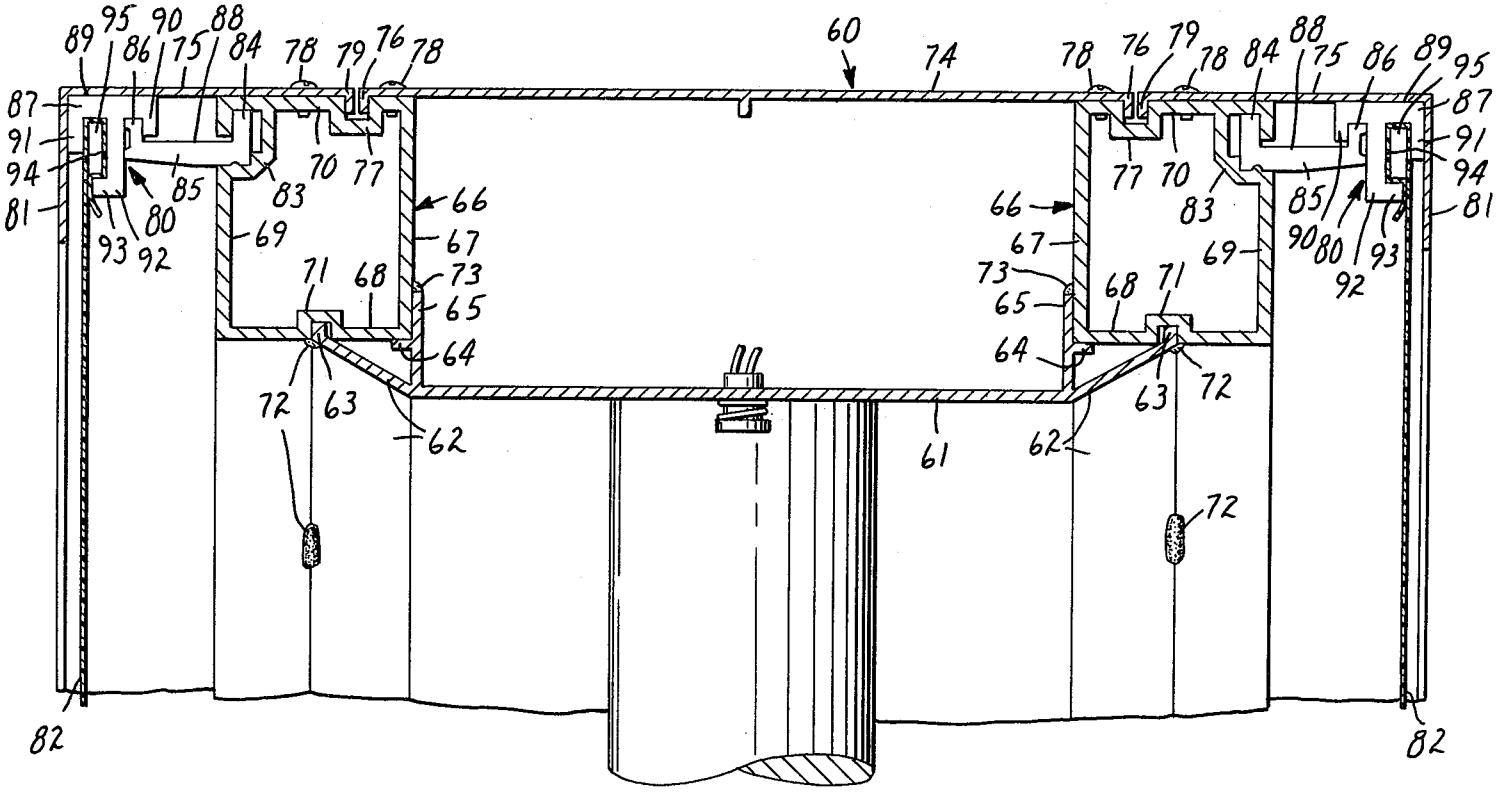
FIG. 5 is a sectional view of a modified form of the invention.
Figure 7:
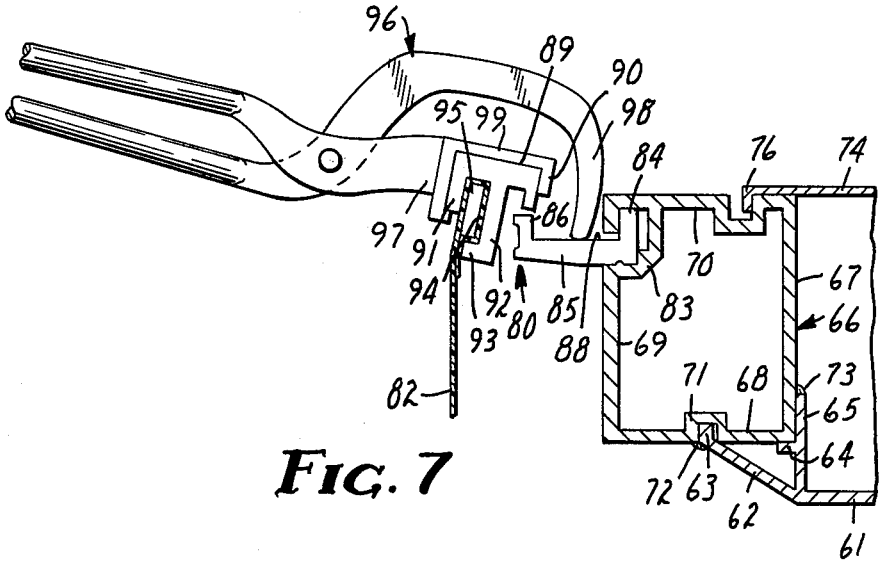
FIG. 7 is a view of the means of placing the clamping assembly onto a clamp support bar of the modified form of the invention.

A modified version of the invention is shown in FIGS. 5–7. Modifications of this type are used for on premise signing situations where a smaller and somewhat lighter sign cabinet such as one having overall dimensions up to 7×14 feet (2.1×4.3 m).

Similar to cabinet 10 described above, the modified cabinet generally designated 60 has a main frame 61 which is substantially planar in cross section as seen in FIG. 6. In the modified form angularily inclined integral support plate members 62 extend upwardly from each side of the frame and terminate in locking means 63. Flanges 64 which seat support frame 66 are positioned at the upper end of the truncated sides 65 of main frame 61. See FIG. 5.

Similar to the embodiment described above, the modified form has a completely enclosed support frame generally designated 66 consisting of four spans of box beam members with walls 67, 68, 69 and 70 similar to support frame 17.

However, frame 66 has a channel 71 on its lower wall 68 rather than on its side wall as can be seen by comparing FIGS. 3 and 5. The locking means 63 of support plate 62 is secured in channel 71 by tack welding at weld 72 to fasten support frame 66 to main frame 61. Additionally, to further secure the support frame to the main frame, the two units are tack welded at welds 73 at the distal end of the truncated side 65 as viewed in FIG. 5. A cover 74 and retainer 75 are secured to each of the box beams of frame 66 in the same manner as described with reference to the embodiment shown in FIGS. 1–4. Cover 74 has down turned edge 76 seating in an upper race 77 of each box beam and is secured by sheet metal screws 78. The cover forms the enclosure over the main frame 61. Retainer 75 is likewise secured by a down turned edge 79 in channel 77 and by sheet metal screws 78 to form a covering over the clamp assembly generally designated 80. Ratainer 75 has an extension 81 extending downward (as seen in FIG. 5) at right angles from the horizontal axis of cover 74 to cover the marginal edge of the flexible PVC sign face 82. Face 82 is of the same material as face 36 described above.

Similar to the embodiment shown in FIGS. 1–5, the modified cabinets 50 may be designed to secure a single sign face 82 rather than a double face as shown in the drawings. In such case, the main frame 60 and cover are truncated at one side of the frame, the second support frame 66 and retainer 75 are eliminated and replaced by a rear panel so that cabinet 60 has only a single display face.

Also similar to the above-described embodiment and as seen in FIGS. 5 and 6, support frame 66 has a substantially inverted G-shaped race 83 which seats a flanged lip 84 of the clamp support bar 85 for slidable movement in the race. The clamp support bar of this modification is similar to bar 38 except that the distal end has a second lip 86 defining a clamp support head for seating the wedge clamp 87 on the bar. The portion of bar 85 between lips 84 and 86 at each end forms a planar section or flat plate 88 (See FIG. 6).

In this modification, the wedge clamp 87 is of serpentine cross-section configuration when viewed in FIGS. 5 and 6. The clamp body 87 has a planar cap 89, an inner stub 90 and an outer stub 91 extending downward (as seen in FIGS. 5, 6 and 7) normal to the plane of cap 89 along the outer edges of the cap. The distal end of outer stub 91 extends approximately twice the distance from cap 89 as the end of stub 90. A median projection 92 similar in configuration to stubs 90 and 91 also extends down (as seen in FIGS. 6 and 7) normal to cap 89 and is centrally spaced and parallel to the stubs 90 and 91. A lug 93 is formed at the distal end of projection 92 to form a recess 94 which secures a hanger bar 95 in the same manner as described with respect to recess 51 and hanger bar 52 in the embodiment shown in FIGS. 2–4.

In this embodiment the linear length of the individual clamp support bars 85 is about 3 inches (7.62 cm) and the linear length of the wedge clamps 87 are about 1½ inches (3.81 cm). The hanger bar 95 is slightly longer than the linear length of the wedge clamp.

The preferred procedure of mounting face 82 in the FIGS. 5–7 modification is similar to that described with respect to the embodiment shown in FIGS. 1–4 and best visualized by viewing FIGS. 7 and 8. The marginal edges of sign face 82 after being properly marked as indicated above are wrapped around each of the hanger bars 95 which in turn are manually placed into recesses 94 of each clamp assembly 80. These clamp assemblies along with their respective clamp support bars 85 are placed in race 83 along the top span of the cabinet formed by the top beam of support frame 66. In this position, face 82 is draped over the front of the cabinet.

All of the remaining clamps are inserted on their respective clamp support bars 85 by means of a special tool 96 described in my copending application mentioned above. Of the remaining clamps, the first wedge clamps to be assembled onto clamp support bars 85 are at the respective positions A, B and C of FIG. 8. After these wedge clamps are placed on their clamp support bars, all the remaining wedge clamps are placed in position at random along the side and lower spans of the cabinet as visualized in FIG. 8.

In mounting each individual wedge clamp 87 onto its respective clamp support bar 85, the wedge clamp is manually placed in a channel retainer 99 at the end of jaw 97 of tool 96. The handles of the tool are closed providing some tension on face 82 and the end of jaw 98 is placed on the planar section or plate 88 of the clamp support bar. The operator then rotates the tool in an upward direction (as viewed in FIG. 7) to provide additional tension on face 82 and move the wedge clamp into position over lip 86. The wedge clamp is then dropped so that it is seated and locked into position by means of lip 86 and stub 90 and projection 92 (see FIG. 6).

Using tool 96 eliminates the necessity of tightening each wedge clamp by nut and bolt systems.

The method of fabricating and assembling sign cabinets incorporating the modifications of FIGS. 5–7 is the same as described with respect to the cabinets shown in FIG. 1–4.

The above embodiments of sign cabinets when constructed of extruded aluminum are light weight and have considerable structural strength. Additionally, they have the distinctive feature that the support frames 17 and 66 consisting of the completely enclosed box beams have sufficient structural strength to support the sign face under tension with a minimum of reinforcing braces and struts such as the strut 100 shown in FIG. 1.

This feature not only affords easy assembly and reduces costs of fabrication, but is significant when designing specific cabinets to withstand the varying degrees of wind forces encountered in different "on premise" signing environments. To obtain maximum visibility (and thus advertising capabilities), many on premise signs are mounted at considerable distances above ground surface in many cases 50–100 feet (15.2–30.4 m) or or more. Wind pressures increase significantly even at short distances above ground. For example, a 100 mile per hour (160 km) wind will exert a force of 42 psf (105 kg/m$^2$) at 0–15 feet (0–4.5 m) above ground. At 100 feet (30.48 m) above ground the force increases to 58–65 psf (283–317 kg/m$^2$). Thus a cabinet placed at 100 feet (30.48 m) above ground surface must withstand a wind force considerably greater than cabinets placed in the range of 15 feet (4.5 m) above the surface.

The additional strength of sign cabinets designed in accordance with this invention is also significant when considering that the effect of wind forces exerted against a flexible sign face secured under tension is considerably different than the wind force against rigid (such as plastic) sign faces.

When the wind strikes the tension mounted flexible face, the face tends to be displaced normal to its horizontal or vertical axis. This tendency exerts a force along the perimeter of the sign cabinet, such as support frames 17 and 66 and main frames 12 and 61 of this invention. This force is in a direction that tends to buckle the cabinet towards the center point framed by the cabinet.

In order to develop a sign cabinet adaptable to withstand wind pressures in areas which experience high wind velocities and gusts, the cabinet must therefore have sufficient strength to withstand not only the force exerted by the wind but also the force exerted on the cabinet's perimeter resulting from mounting the flexible face under tension. Additionally, to keep manufacturing and fabricating costs and the weight of the cabinet at minimum levels, the perimeter of the cabinet should be of sufficient structural strength to provide unsupported spans of significant length without the need to add costly braces and other reinforcing structures to prevent buckling.

For example, in a 7×14 ft (2.1×4.3 m) sign cabinet supported by a single center pole 11, the box beams which comprise the support frame have a structural strength sufficient to provide unsupported spans of up to about 78 inches (1.98 m) without exposing the cabinet to the potential danger of buckling even though the face is exposed to wind velocities up to 100 miles per hour (160 km) which exerts a force against the flexible sign face of approximately 50 psf (244 km/m$^2$).

The maximum length of unsupported spans using the above extruded aluminum, box beam members forming the support frame can be calculated using conventional structural formulas.

Using a 100 mph (160 kmh) wind force [i.e. a 50 psf (244 km/m$^2$) force] on the sign face mounted in a 7×14 foot (2.1×4.3 m) cabinet, one first determines the force on the perimeter of the support frame by the following formulae:

$$F = \left( \frac{H \times L \times psf\,(\text{kg/m}^2)}{\text{Perimeter (in inches or m)}} \right) + X$$

where:

F=Force on the perimeter of the spans of box beams which make up the support frame H=Height of cabinet in ft (m)

L=Length of cabinet in ft (m)

50 (244)=psf (kg/m$^2$) wind force on sign face

Perimeter=perimeter of support frame in inches (meters)

X=face tension force per inch or meters on support frame=2.50 lbs (44.65 kgm)

Assuming a 7×14 foot (2.1×4.3 m) cabinet, the force on its perimeter is 12.22 lbs/in (215.45 kg/m):

$$F = \frac{7 \times 14 \times 50}{504} + 2.50 = 12.22 \text{ lbs/in}$$

Converted to metric system measurements:

$$F = \left( \frac{2.1 \times 4.3 \times 2.44}{12.9} \right) + 44.65 = 215.45 \text{ kg/m}$$

With the total force per inch (meter) along the support frame computed, the maximum unsupported length of span of the support frame can then be computed by the formula:

$$S = \sqrt[4]{\frac{K \times E \times I \times D}{F}}$$

where:

S=maximum length of unsupported span in inches (m)

E=modulus of elasticity of extruded aluminum support frame

I=moment of inertia

D=maximum allowable deflection prior to buckling based on a constant of 1/360th of the span length F=force on perimeter derived from above formula [12.22 lb/in (215.45 kg/m)]

K=constant for structural beam formulae=185

Assuming the 7×14 foot (2.1×4.3 m) cabinet described above, the maximum lengths of unsupported span is 78.3 inches (1.98 m) determined as follows:

$$S = \sqrt[4]{\frac{185 \times 10 \times 10^6 \times 1.081 \times .23}{12.22}} = 78.32$$

Converted to metric system measurement:

$$S = \sqrt[4]{\frac{185 \times 70.3 \times 10^8 \times 2.740 \times .584}{215.45}} = 1.98 \text{ m}$$

Another distinctive advantage of the sign cabinets of this invention results in the fact that each clamp assembly 37 and 80 can support up to 230 pounds (104 kgm) of tension (force on clamp resulting from wind pressure and the tension mounting of the sign face). The fact that the marginal edges of the flexible face are wrapped around hanger bars 52 or 95 provides added tensioning strength as it is not necessary to provide any apertures or apply serrated gripping surfaces along the margin of the face.

The proper center to center distances between the individual clamp assemblies along races 24 and 83 is based on the total force (F) on the perimeter of the frame as computed in the above formula. The preferred center to center distances for cabinets up to 300 square feet (27.87 $m^2$) including the 7×14 (2.1×4.3 m) cabinet as described above is 16 inches (40.64 cm). Obviously the distances between the clamp assemblies for larger signs decrease as indicated in Table I below.

TABLE I

| Distances Between Clamp Assemblies | |
|---|---|
| Cabinet Size | Spacing at wind load of 244 kg/$m^2$ |
| up to 27.87 (sq/m) | 40 cm |
| 27.87–32.5 (sq/m) | 38 cm |
| 32.5–37.15 (sq/m) | 35.5 cm |
| 37.15–41.80 (sq/m) | 33 cm |

What is claimed is:

1. A sign cabinet for supporting a flexible sign face under tension comprising:

(a) a rectangular main frame having top, bottom and side spans in opposed relationship, the spans being formed of sheet material having an integral angularly inclined plate positioned along the major portion of at least one edge of said sheet material and having a locking member at the free end of said plate, (b) a support frame formed by box beam members disposed and connected to form a top, bottom and sides of said support frame, each beam member having four walls and having a race integral with one side wall thereof and in such position being symmetrical about the central axis of said support frame with the races in the beam members being in opposing relationship for positioning a plurality of means to secure said flexible sign face under tension across the opening formed by the support frame and one wall of each box beam member having a channel to form a symmetrical channel about the support frame, and said support frame being supported by said locking members to said main frame with the locking members on said top, bottom and side spans being positioned in the channel on the walls of said box beam members.

2. A sign cabinet as defined in claim 1 wherein said plurality of means to secure said flexible sign face under tension comprises individual clamp assemblies slidably affixed to said race in spaced relationship to each other and disposed in an array along the top, bottom and sides of said support frame so that each of said individual clamp assemblies are positioned thereon opposite another individual clamp assembly in the array.

3. A sign cabinet as defined in claim 2 wherein each clamp assembly has bar means associated therewith affixed to the marginal edge of said face to hold same under tension.

4. A sign cabinet as defined in claim 3 where the tension under which the marginal edge of said sign face is affixed to said bar means associated with each clamp assembly is sufficient to withstand a wind force up to 244 kg/$m^2$ against the sign face normal to the plane of said face.

5. A sign frame as defined in claim 2 wherein said individual clamp assemblies are spaced from each other in said race a distance ranging from 33 to 40 cm.

6. A sign cabinet as defined in claim 1 wherein the box beams forming said suport frame suspend said sign face under tension by said plurality of means along unsupported span lengths of support frame up to about 2 meters.

7. The sign cabinet as defined in claim 1 further comprising a cover member partially extending over said support frame and over said main frame forming an enclosed space between said cover member and main frame.

8. The sign cabinet as defined in claim 1 further comprising a retainer partially extending over said support frame box beam and over said support bar and wedge clamp.

9. The sign cabinet as defined in claim 8 further comprising an extension member extending normal to the horizontal axis of said retainer and forming a partial enclosure in spaced relation to said wedge clamp and support bar.

10. The sign cabinet as defined in claim 1 wherein said support bar comprises a flanged lip at one end slidably secured in the race of said support frame, a second lip at the opposite end of said bar and a planar section disposed between the flanged lip and second lip.

11. The sign cabinet as defined in claim 1 wherein the end of said bar slidably disposed in said race has a flanged lip for engaging said race.

12. The sign cabinet as defined in claim 1 wherein said wedge clamps have nut and bolt means associated with said support bar for moving the wedge clamp and said hanger bar disposed in the recess of the wedge clamp in a direction normal to the horizontal axis of said support bar.

13. The sign cabinet as defined in claim 1 wherein the means in each of said wedge clamps forming a recess therein comprise a planar cap member with inner and outer stubs projecting from the edges of the cap and a projection extending parallel with said stubs and centrally disposed between the stubs, said wedge clamp member secured to said support bar by said inner stub member and projection.

14. The sign cabinet as defined in claim 13 wherein said projection and outer stub of said wedge clamps form said recess.

15. The sign cabinet as defined in claim 1 wherein the means in each of said wedge clamps defining said recess comprise inner and outer stubs integral with said wedge clamp and extending parallel in spaced relation to each other and normal to the horizontal axis of the wedge clamp, the inner stub extending beyond the end of the outer stub and having a lug at the distal end thereof.

16. A sign cabinet comprising:

(a) a main frame forming an enclosed polygonal configuration, (b) at least one completely enclosed support frame having a side secured coextensively to said main frame, said support frame being formed by lengths of box beams having a race on the side thereof opposite the side secured to said frame, (c) a plurality of support bars having one end slidably disposed in said race and positioned therein in an opposing array around the periphery of said cabinet, said support bars forming a cantilever support for a clamp support head, (d) a plurality of wedge clamps each secured to a respective clamp support head of said support bar and each having means defining a recess therein, (e) a hanger bar disposed in said recess, and (f) a flexible sign face having its marginal edges affixed to said hanger bars for mounting said face in the recesses of said wedge clamps on said support means.

17. A method for assembling a sign cabinet for holding a flexible sign face under tension comprising the steps of (a) assembling a main frame and a support frame affixed coextensively to at least one side of the main frame to form an enclosed polygonal configuration having four interconnected sides, (b) placing a plurality of individual clamp assemblies in a race in said support frame so that the clamp assemblies are in spaced relationship to each other and disposed in an opposing array along said sides of said configuration, (c) securing the marginal edge of said sign face to said clamp assemblies on a first side of said configuration, (d) securing the marginal edge of said face to a clamp assembly centrally disposed on a second side of said configuration, (e) applying a tension force to said clamp assembly on said second side of said configuration to place said face under tension, (f) securing the marginal edge of said face to a clamp assembly centrally disposed on each of the remaining sides of said configuration, (g) applying a tension force to said clamp assemblies centrally disposed on said remaining sides of said configuration to place said face under tension, (h) securing the marginal edge of said face to remaining clamp assemblies along said second and remaining sides of said configuration and applying a tension force to same to place said face under tension.

18. The method as defined by claim 17 wherein said steps of applying a tension force to said clamp assemblies to place said face under tension comprise the step of tightening nut and bolt means on each of said clamp assemblies.

19. The method as defined in claim 17 wherein said steps of applying a tension force to said clamp assemblies to tension said face comprises the steps of applying a tool to a first part of said clamp assembly, applying a force of tension to said face by manipulating said tool and connecting said first part of said clamp assembly to a second part of said clamp assembly by means of said tool.

20. The method as defined by claim 17 which further comprises the steps of (a) preassembling a cover and retainer to linear lengths of said main frame and support frame, (b) cutting the linear lengths of said preassemblled cover, retainer, main frame and support frame to desired lengths to form the interconnected sides of said polygonal configuration, (c) removing the cut lengths of said cover and retainer from the cut lengths of said main frame and support frame, and (d) further assembling said main frame and support frame by interconnecting said lengths to form sides, top and bottom members of said polygonal configuration to form same into a rectangular polygon.

* * * * *

UNITED STATES PATENT AND TRADEMARK OFFICE

CERTIFICATE OF CORRECTION

PATENT NO. : 4,317,302

DATED : March 2, 1982

INVENTOR(S) : Von De Linde

It is certified that error appears in the above—identified patent and that said Letters Patent is hereby corrected as shown below:

Col. 8, L. 57-58 : "96 described in my copending application mentioned above" should be -- such as tool 96 shown in Fig. 7 and hereafter described --.

Col. 9, L. 14 : "Fig" should be -- Figs --.

Col. 12, L. 25, 30, 39, 44, 47, 53 and 64: the claim reference numeral "1", each occurrence, should read -- 16 --.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*